United States Patent [19]

Myers et al.

[11] Patent Number: 4,980,099

[45] Date of Patent: Dec. 25, 1990

[54] AIRFOIL LANCE APPARATUS FOR HOMOGENEOUS HUMIDIFICATION AND SORBENT DISPERSION IN A GAS STREAM

[75] Inventors: Robert B. Myers, Copley; Anthony S. Yagiela, North Canton, both of Ohio

[73] Assignee: The Babcock & Wilcox Company, New Orleans, La.

[21] Appl. No.: 465,276

[22] Filed: Jan. 16, 1990

[51] Int. Cl.[5] ..... B01F 3/04

[52] U.S. Cl. ..... 261/116

[58] Field of Search ..... 261/116

[56] References Cited

U.S. PATENT DOCUMENTS

| | | | |
|---|---|---|---|
| 2,687,614 | 8/1954 | Goddard | 261/116 |
| 3,181,287 | 5/1965 | Rabson | 261/116 |
| 3,521,824 | 7/1970 | Wilcox | 261/116 |
| 3,608,274 | 9/1971 | Stingelin et al. | 261/116 |
| 4,019,896 | 4/1977 | Appleby | 75/44 |
| 4,083,932 | 4/1978 | Muraco et al. | 261/116 |
| 4,130,611 | 12/1978 | Brand | 261/116 |
| 4,180,455 | 12/1979 | Taciuk | 208/126 |
| 4,285,773 | 8/1981 | Taciuk | 202/100 |
| 4,285,838 | 8/1981 | Ishida et al. | 252/469 |
| 4,314,670 | 2/1982 | Walsh, Jr. | 239/11 |
| 4,384,873 | 5/1983 | Herr | 261/116 |
| 4,455,281 | 6/1984 | Ishida et al. | 422/171 |
| 4,891,170 | 1/1990 | Kokkonen et al. | 261/116 |

FOREIGN PATENT DOCUMENTS

| | | | |
|---|---|---|---|
| 1077621 | 3/1984 | U.S.S.R. | 261/116 |
| 584530 | 1/1947 | United Kingdom | 261/116 |

OTHER PUBLICATIONS

Walsh, W. A. Jr., "A General Disclosure of Major Improvements in the Design of Liquid-Spray Gas Treating Processes Through Commercial Development of the Linear VGA Nozzle", publication date unknown, document distributed to solicit interest in licensing U.S. Pat. No. 4,314,670.

"LIMB Demo Advances Retrofit Technology for $SO_2/NO_x$ Removal," *POWER*, 1989, pp. 57–58 & 60.

"EPA's LIMB Development and Demonstration Program", Journal of the Air Pollution Control, vol. 36, No. 4, Apr., 1986, pp. 432–439.

Amrhein, G. T. and Smith, P. V., "In-Duct Humidification System Development for the LIMB Demonstration Project", presentation at APCA meeting, Dallas, Jun. 19–24, 1988.

Nolan, P. S. and Hendriks, R. V., "Initial Test Results of the Limestone Injection Multistage Burner (LIMB) Demonstration Project," presentation at APCA meeting, Dallas, Jun. 20–24, 1988.

Yagiela, A. S. et al., "The DOE Sponsored LIMB Project Extension and Coolside Demonstration", presented to Energy Technology Conference & Exposition, Washington, D.C., Feb. 18, 1988.

*Primary Examiner*—Tim Miles

*Attorney, Agent, or Firm*—Vytas R. Matas; Robert J. Edwards; Daniel S. Kalka

[57] ABSTRACT

An apparatus for spraying an atomized mixture into a gas stream comprises a stream line airfoil member having a large radius leading edge and a small radius trailing edge. A nozzle assembly pierces the trailing edge of the airfoil member and is concentrically surrounded by a nacelle which directs shielding gas from the interior of the airfoil member around the nozzle assembly. Flowable medium to be atomized and atomizing gas for atomizing the medium are supplied in concentric conduits to the nozzle. A plurality of nozzles each surrounded by a nacelle are spaced along the trailing edge of the airfoil member.

11 Claims, 3 Drawing Sheets

AIRFOIL LANCE APPARATUS FOR HOMOGENEOUS HUMIDIFICATION AND SORBENT DISPERSION IN A GAS STREAM

The Government has rights in this invention pursuant to Contract and Grant Nos. 68-02-4000 and 6-85-090, DE-FC22-87PC79798 and CDO/D-86-25, and CDO/D-86-29 awarded by the U.S. Environmental Protection Agency, State of Ohio, and the U.S. Department of Energy.

FIELD AND BACKGROUND OF THE INVENTION

The present invention relates in general to an airfoil lance apparatus for homogeneous humidification and/or sorbent dispersion in a gas stream A removable airfoil lance assembly of the invention contains a plurality of atomizers and related supply piping and hardware for in-duct installation in a gas stream. Atomizer shields are provided around the atomizers for the uniform distribution of a shield gas to each atomizer.

There are many reasons for conditioning a process gas stream. These include:

improving particulate collection capabilities (i.e., electrostatic precipitator performance enhancement);

quenching or cooling of a gas stream to meet process requirements or to accommodate process equipment limitations (i.e., gas volume reduction); and facilitating process chemical reactions where a gas/-liquid/solid phase interaction is required (e.g., sorbent injection for sulfur dioxide capture).

It is known to use sulfur trioxide injection into a particulate laden flue gas steam to reduce the resistivity of fly ash particulate. This results in an electrostatic precipitator collection efficiency improvement. Sulfur trioxide injection is typically carried out by conversion of liquid sulfur dioxide or elemental sulfur to sulfur trioxide prior to injection upstream of the electrostatic precipitator Quenching or cooling of a process gas stream (e.g., flue gas) via humidification is also known and is carried out by spraying a fine rest of water droplets into a process gas stream, giving rise to evaporation of the water droplets and an increase in moisture content of the gas. Humidification to high (80° F. to 100° F.) approaches to saturation temperature (i.e., low to moderate increases in gas humidity) can be easily achieved via installation of a simple spray nozzle in the gas duct. This is particularly true for a particulate free process gas. A typical problem arising in a particulate laden process gas application is the buildup of solids on the spray nozzle. If the deposit grows large enough, it can interfere with atomization spray quality, resulting in large droplets and greater evaporation time requirements. However, at a high approach to saturation temperature, the large temperature driving force for evaporation compensates, to a point, for poor droplet size distribution. Hence, quenching or cooling to high approaches to saturation temperature by means of spray evaporation is carried out frequently in many applications that require an immediate reduction in process gas temperature.

Dry scrubbing technology which depends on the presence of moisture to achieve reaction of sulfur dioxide with sorbent is commercially available for sulfur dioxide removal from flue gases Babcock & Wilcox, Flakt, Joy Niro and Research Cottrell are the major manufacturers of dry scrubbers.

Treatment of flue gas with moisture and with sorbents injected dry or as slurries via the Linear VGA Nozzle is also known (U.S. Pat. No. 4,314,670 to Walsh Jr.).

U.S. Pat. No. 4,314,670 to Walsh, Jr. discloses a linear variable gas atomizing nozzle best illustrated in FIGS. 12 and 13 of that reference. This reference does not offer a low gas stream side pressure drop housing which solves the problem of opposition on the nozzle, however.

An article by William A. Walsh, Jr. "A General Disclosure of Major Improvements In the Design of Liquid-Spray Gas Treating Processes Through Commercial Development of Linear VGA Nozzle,", distributed by the author to solicit interest in this technology, describes improvements in a liquid-spray flue gas treating process which utilizes the Linear VGA Nozzle design. FIG. 3 of this article discloses the nozzle. This reference lacks both an airfoil geometry and shield air provision, resulting in increased process gas side pressure losses and deposition of solids on the nozzle, respectively.

An airfoil lance assembly is discussed in very general terms on page 11 in a technical paper presented to the Energy Technology Conference & Exposition in Washington, D.C. on Feb. 18, 1988. This technical paper mentions a shield air system. There are no drawings depicted in the article, or any details concerning the structure of the air foil lance apparatus.

A technical article by P.S. Nolan and R.V. Hendricks, "EPA's LIMB Development and Demonstration Program," Journal of the Air Pollution Control Association, Vol. 36, No. 4, April, 1986 describes features of a limestone injection multistage burner (LIMB) system at Ohio Edison's Edgewater Station. The arrangement of injectors for sorbent injection is discussed on pages 435–436.

A technical presentation by G.T. Amrhein and P.V. Smith, "In-Duct Humidification System Development for the LIMB Demonstration Project," presented at the 81st Annual Meeting of the Air Pollution Control Association Dallas Texas, June 20–24, 1988, describes the development of an in-duct humidifier with optimum arrangement of atomizers.

A technical presentation by P.S. Nolan and R.V. Hendricks, "Initial Test Results of the Limestone Injection Multistage Burner (LIMB) Demonstration Project" presented at the 81st Annual Meeting of the Air Pollution Control Association, Dallas Texas, June 20–24, 1988, describes the Edgewater LIMB design and operating conditions with the concept of humidification.

Additional references which are relevant to the present invention are U.S. Pat. Nos.:

4,285,838 to Ishida, et al.;
4,019,896 to Appleby;
4,180,455 to Taciuk;
4,455,281 to Ishida, et al.; and
4,285,773 to Taciuk.

None of the above disclosures reveals details or design configurations of an airfoil lance of the present invention, which solves the problems of nozzle deposition and pressure drop.

SUMMARY OF THE INVENTION

An object of the present invention is to provide an airfoil lance apparatus for homogeneous humidification and sorbent dispersion in a gas stream A purpose of the invention is to provide the most aerodynamically efficient shape possible for a removable lance assembly containing a multiple number of atomizers and all related supply piping and hardware for in-duct installation in a process gas stream.

A further object of the present invention is to provide an airfoil lance apparatus comprising: an airfoil member having a large radius leading edge for facing an oncoming flow of gas into which an atomized mixture is to be sprayed, and a small radius trailing edge for facing oppositely to said leading edge; a flowable medium conduit extending in said airfoil member and having an inlet and an outlet, for supplying flowable medium; an atomizing gas conduit extending in said airfoil member and having an inlet and an outlet, for supplying atomizing gas; at least one mixing chamber in said airfoil member connected to the outlets of said flowable medium conduit and said atomizing gas conduit for mixing the medium with the atomizing gas to form an atomized mixture; nozzle means connected to said chamber and extending from said trailing edge for spraying the atomized mixture in a downstream direction into the process gas stream; a nacelle connected to said trailing edge and extending over said nozzle means, said nacelle defining an annular shielding gas discharge space for uniformly discharging shielding gas from said airfoil member around said nozzle means and in the downstream direction into the process gas stream; said nacelle with an internal flow restricting orifice for uniformly distributing shielding gas among the plurality of atomizing nozzles; and shielding gas supply means connected to said airfoil member for supplying shielding gas to the discharge space.

A further object of the present invention is to provide an airfoil lance apparatus which, by minimizing turbulence in the gas stream, avoids the deposition of particles onto surfaces of the apparatus, in particular surfaces around and under the nozzle The design of the present invention also reduces pressure drop across the apparatus and is constructed in order to entirely eliminate the likelihood of liquid or sorbent leakage to the exterior surfaces of the airfoil.

A further object of the invention is to provide an airfoil apparatus which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
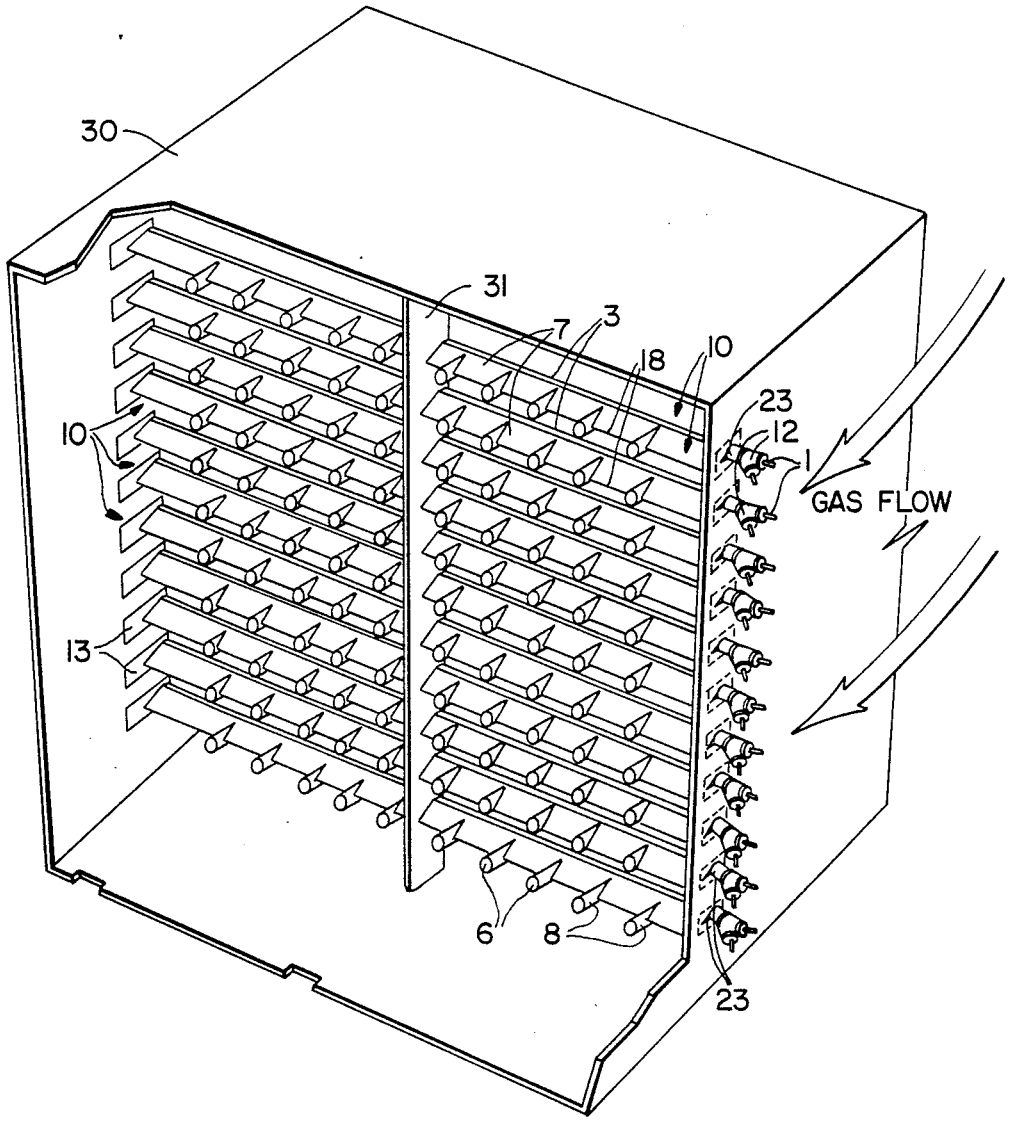
FIG. 1 is a partial perspective view of a duct for receiving a gas stream, in which a multiplicity of airfoil lance apparatuses of the present invention have been installed.

Referring to the drawings in particular, the invention embodied in FIG. 1 is an arrangement for spraying an atomized mixture in a downstream direction into a flow of gas which is contained within a conduit 30. A multiplicity of airfoil lance apparatuses generally designated 10 are positioned within the conduit 30. Each includes a plurality of rearwardly directed nozzle assemblies for spraying the atomized mixture.

Figure 2:
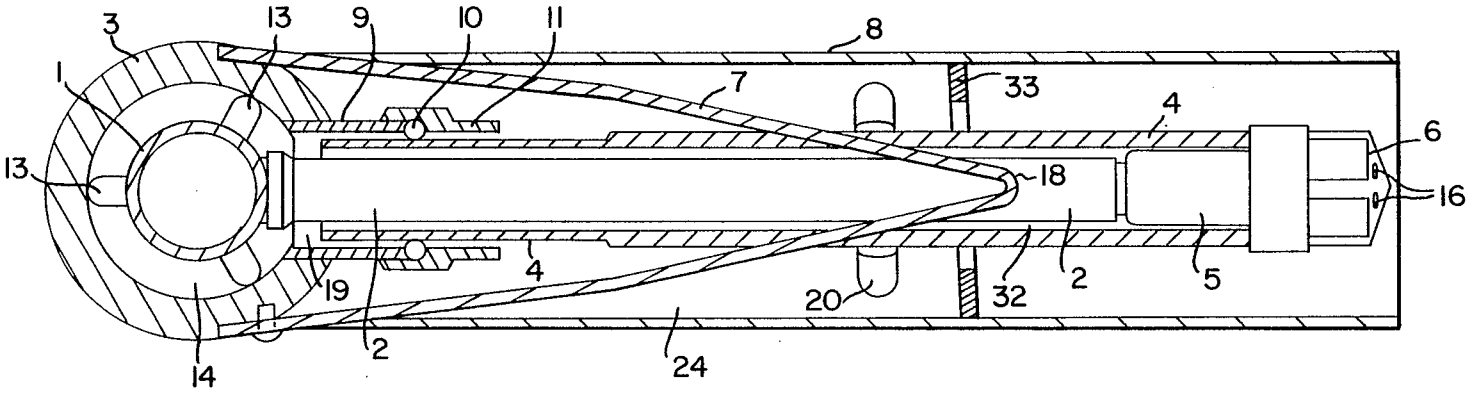
FIG. 2 is a sectional view taken along line 2—2 of FIG. 3 showing the construction of the airfoil lance apparatus of the present invention.
Figure 3:
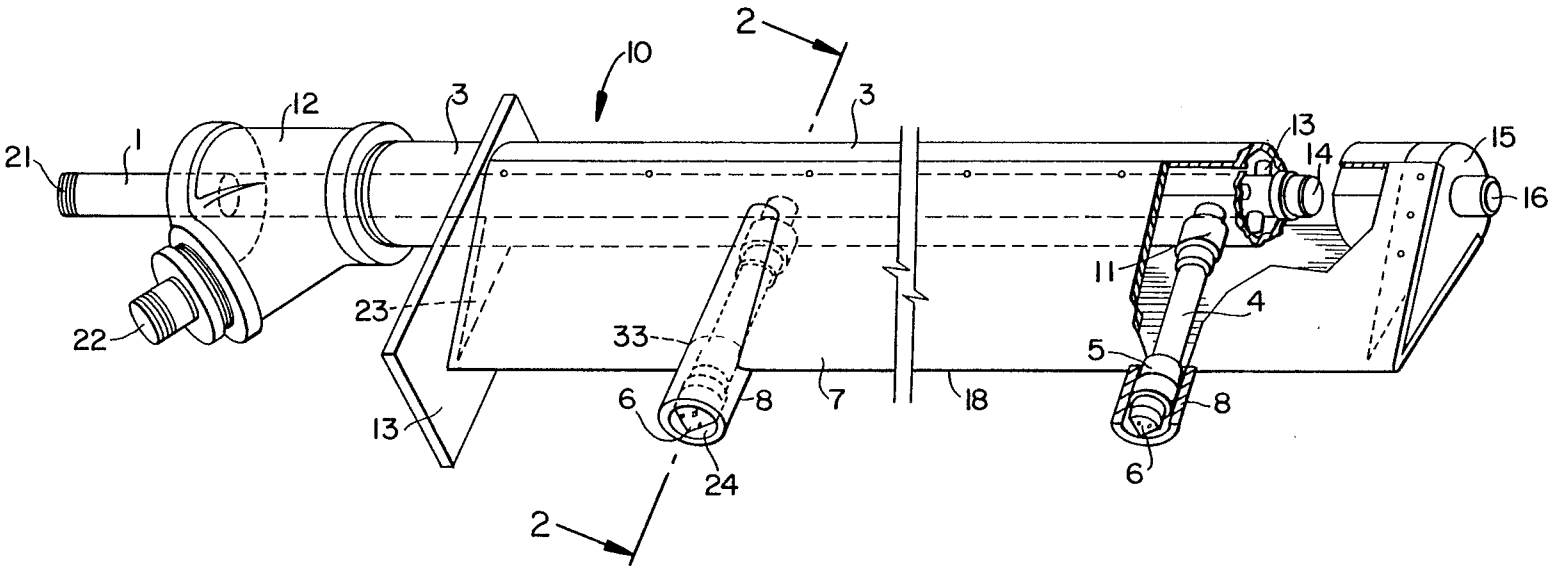
FIG. 3 is a partial perspective view of the airfoil lance apparatus of the present invention, with portions cut away for clarity.

Referring to FIGS. 2 and 3, the invention comprises the apparatus generally designated 10. Water or sorbent to be atomized enters an inner header manifold 1, at a port 21. The inner header manifold 1 supplies the water or sorbent to an atomizer mix chamber 5, via an inner barrel 2.

The inner header manifold 1, is positioned by spacers 34 concentrically within an outer header manifold 3, which forms the leading edge of the airfoil lance apparatus. Atomizing gas enters a service supply lateral 12, through an atomizing gas inlet port 22, which directs the air to an annulus 14 formed between the inner header manifold 1 and the outer header manifold 3. The gas flows through this annulus and subsequently to the atomizer mix chamber 5, by entering, through an inlet port 19, an annulus 32 formed between the inner barrel 2, and an outer barrel 4 held by alignment spacers 20. The homogenized mixture of gas, liquid and/or solids exit the atomizer mix chamber 5, and subsequently nozzle openings 16 of an atomizer end cap 6.

Outer barrel 4 is held to manifold 3 by a packing gland 9, an O-ring 10 and a packing gland nut 11.

Atomizer shield gas enters through a shield gas port 23 in a mounting plate 13 and is ducted through the passageway bounded in part by the outer header manifold 3, and an airfoil skin 7 which is fixed to manifold 3. Subsequently the shield gas flows over the atomizer end cap 6, by entering an annulus 24 formed between the outer barrel 4 and a nacelle housing 8 extending from the trailing edge 18 of the airfoil skin 7. Uniform distribution of shield gas flow among the plurality of atomizers is accomplished through the use of a uniquely sized flow distributing orifice 33 fixed to the interior wall of each nacelle housing 8.

Superficial gas flow first contacts the airfoil at the leading edge, i.e., the outer header 3, forming a stagnation point on the body's leading edge where flow is stopped. Symmetrically from the stagnation point, a laminar boundary layer is formed as gas starts to move around the body. The boundary layer consists of a thin sheet of gas immediately adjacent to the body surface. Gas velocity within the boundary layer is low due to friction between the gas and the surface of the body and a laminar or smooth flow distribution results. As the flow continues over the leading edge of manifold 3, and over the airfoil skin 7, the boundary layer thickens and becomes unstable, forming a turbulent boundary layer which continues to the trailing edge 18 of the airfoil skin 7. If the body is not a streamlined airfoil shape, the turbulent boundary layer which becomes more unstable as it moves along the body, separates from the body surface. The separated flow forms a turbulent wake which results in an aerodynamic force resisting movement of gas past a non-airfoil body. The flow separation increases the drag experienced on a body as gas moves past it. The airfoil design which entails the leading edge of manifold 3, and the airfoil shaped skin 7, minimizes flow separation and hence aerodynamic drag on the body. The drag coefficient $C_D$ for the airfoil shape is approximately 0.27 versus 1.2 for a round pipe which is not streamlined. The nacelle enclosure 8 around each atomizer further isolates the atomizer from any turbulence created at the trailing edge 18 of the airfoil. Skin 7 is closed at one end by plate 13 and at its opposite end by a register plate 15 that carries an alignment pin 17 which is seated in a support 31 of the duct 30 shown in FIG. 1.

As shown in FIGS. 1 and 3, a plurality of nozzle assemblies 4, 5, 6 extend from the trailing edge 18 of the airfoil member which is composed of the manifold 3 forming a large radius leading edge of the airfoil member facing the oncoming flow of gas and the airfoil skin 7 forming the small radius trailing edge 18 facing in the opposite direction. The manifolds 1 and 3 with their inlets 21 and 22 form a flowable medium conduit and an atomizing gas conduit, respectively. The shielding gas inlet port 23 and the interior space of airfoil skin 7 together form shielding gas supply means for supplying the shielding gas to the annular spaces 24 formed by the nacelles 8.

The critical features of the invention include: 1. The airfoil shape of the apparatus minimizes the generation of separation turbulence associated with placement of a body in a gas stream with superficial velocity. This turbulence would otherwise result in gas recirculation patterns which provide the vehicle for particulate deposition on surfaces in contact with the gas stream. This problem is further compounded by recirculation patterns generated by aspiration mechanisms produced from the operation of an atomizer (i.e. entrainment of surrounding gas by each individual atomizer jet). 2. The shield gas supply provision is accomplished by the attachment of a nacelle enclosure around each atomizer nozzle assembly positioned along the trailing edge of the airfoil. This enclosure provides an annular flow path for the uniform distribution of shield gas to the atomizer nozzle end cap. 3. The concentric arrangement of the service supply piping totally eliminates the possibility of a liquid or sorbent leakage to the exterior surfaces of the airfoil lance apparatus. 4. The design of the airfoil lance apparatus can be adapted to house any known atomizer type currently manufactured (i.e., dual fluid, pressure, rotary cup, vibratory and electrostatic types).

The airfoil lance apparatus of the invention has been installed and operated as part of the LIMB (Limestone Injection Multistage Burner) Demonstration at Ohio Edison's Edgewater Station in Lorain, Ohio to test the invention. Electrostatic precipitator removal performance loss during LIMB operation without the invention resulted from three factors:

1. The particulate loading to the ESP more than doubled. 2. The particle size distribution of the injected sorbent was finer than normal flyash and therefore was more difficult to capture.

3. The sorbent calcium content increased the resistivity of the ash.

Humidification of flue gas has been shown to increase $SO_2$ capture by improving post-furnace sorbent particle reactivity. Although the mechanism by which this occurs is not completely understood, experience shows that $SO_2$ absorption efficiency increases as the final flue gas temperature approaches the adiabatic saturation temperature.

During humidifier operation, sulfur dioxide removal efficiency was observed to increase between 5% and 20% over LIMB performance alone. LIMB without humidification achieved 50% to 55% removal of sulfur dioxide. In addition, no significant ash buildup was observed on the airfoil lance apparatus or the walls of the humidification chamber.

During operation, the invention was demonstrated to achieve and maintain a 25° F. approach to saturation temperature during prolonged periods of operation. Electrostatic precipitator particulate removal performance during LIMB operation was restored by the present invention as indicated by stack opacity and ESP primary/secondary voltage and amperage measurements, as humidification returned particulate resistivity to normal levels.

Thus, humidification with the implementation of the invention, provides a low-cost option to restore precipitator performance at minimal capital and operating costs when compared to those of a sulfur trioxide injection system. This is especially true when sulfur trioxide injection is used in conjunction with LIMB technology. When LIMB is in operation, the same sorbent which increases ash resistivity, causing precipitator performance problems, will chemically react with the sulfur trioxide as well as with the target sulfur dioxide. As a result, significantly greater quantities (e.g., 5 to 10 times estimated) of sulfur trioxide would be required to condition LIMB flue gas for precipitator performance improvement, accompanied by the associated operating cost increase over that to condition normal flue gas. The airfoil lance apparatus allows humidification to be used in place of sulfur trioxide injection for precipitator performance improvement in conjunction with a sulfur dioxide abatement process.

The airfoil lance apparatus of the invention also makes possible, through homogeneous humidification of the gas, achievement of low approaches to saturation. Homogeneous distribution of moisture in the gas allows maintenance of uniform electrical conditions within the precipitator to optimize performance.

Dry scrubber are capital intensive and more economical methods of sulfur dioxide removal are desirable. Such is the goal of the DOE Clean Coal Technology Program where innovative technologies such as in-duct sorbent injection are being investigated. The in-duct sorbent injection system is the major capital item. This technology is installed into existing ducts and therefore is particularly applicable to retrofit of existing units at low capital cost. However, in-duct technology requires humidification of the flue gas to low approaches to saturation (i.e., a goal of 25° F. approach or lower). This is true whether the sorbent is injected as a dry powder or as a slurry in water. Two such processes are the Coolside process to be demonstrated at the Ohio Edison Edgewater plant as part of the LIMB Project where dry sorbent is injected upstream of humidification and E-SOx technology to be demonstrated at the Ohio Edison Burger plant where a lime slurry is injected.

Both processes will require the low approach to saturation temperature to allow significant sulfur dioxide removal to be achieved. Spraying to low approaches can result in localized wet spots if the moisture is not homogeneously introduced into the flue gas stream. In addition, build-up of solids on the atomizers and supply lines will be a problem due to gas recirculation resulting from flow disturbances caused by piping to the atomizers and the atomizer spray pattern itself. The airfoil lance apparatus allows a low approach to saturation temperature to be achieved with homogenous distribution of moisture in the gas without significant localized wetting or solids buildup on the atomizers or airfoil itself.

The concentric header design of the present invention has an advantage in that a water or slurry supply header housed inside the atomizing gas header, which forms the leading edge, minimizes the profile of the airfoil. The exposed surface area onto which solids can collect and form deposits will be reduced as a result. An additional benefit of the concentric header arrangement with the atomizing gas header in the outer position is to maintain the air at a higher temperature, as a result of heat transfer from the process gas through the leading edge of the airfoil into the atomization gas. The higher temperature will prevent the possibility of condensation of acidic components on the surface of the outer header and the resulting corrosion will be stopped. The extended life of the unit as a result of corrosion reduction is commercially significant.

The airfoil lance apparatus provides for a supply of particulate free shielding gas to each atomizer to protect against deposition. The shield gas flow is directed uniformly around each atomizer by the nacelles which are hollow cylindrical shapes surrounding each atomizer. Each nacelle is attached to the trailing edge of the airfoil via a smooth tapering transition. The smooth transition assures minimal turbulence generation. The nacelle, thereby, mechanically protects the atomizer and the shield gas flowing through the annular region between the nacelle interior and the atomizer by developing a blanket of clean gas around it. The shield gas can be clean air or an inert dust free gas should an inert gas be required by the process.

The length of the nacelle extending beyond the trailing edge of the airfoil is important to assure that any turbulence resulting from gas contact with the airfoil is dissipated prior to reaching the atomizer jet. The nacelle length is set at a minimum of one time its diameter to prevent an interaction between airfoil and jet turbulences. These interactions result in recirculation patterns leading to contact of particulate laden gas on the atomizer and airfoil surfaces with consequential ash deposition. The nacelle length and airfoil shape of the apparatus, therefore, contribute to the shield gas effectiveness.

The width of the annular gap between the atomizer and inner wall of the nacelle is important for effective shield gas distribution.

The shield gas is supplied through the internal structure of the airfoil to each nacelle Uniform distribution of shield gas to the individual nacelles is accomplished by the addition of flow orifices at each nacelle inlet as required. No additional piping is necessary to supply shield gas to each atomizer The airfoil lance apparatus is adaptable to applicationspecific process requirements. The nature of the invention's design allows it to be lengthened or shortened to meet specific duct dimensions. Placement of individual nozzles along a single airfoil lance can be varied to address specific process or individual atomizer spacing requirements. Although the original design of the invention accommodated an internal mix atomizer specifically the Babcock & Wilcox I-Jet, Y-Jet and T-Jet designs, any conceivable type of atomizer can be installed within the airfoil housing with minimal modification to the airfoil design.

The airfoil lance apparatus can be easily installed or removed from the process for inspection and maintenance impacting overall process availability. With proper design of the airfoil lance apparatus support system within a gas duct, the apparatus could be removed while the process is on line, serviced and reinstalled without the necessity of an undesired outage.

While a specific embodiment of the invention has been shown and described in detail to illustrate the application of the principles of the invention, it will be understood that the invention may be embodied otherwise without departing from such principles.

What is claimed is:

1. An airfoil lance apparatus comprising:

an airfoil member having a large radius leading edge for facing an oncoming flow of gas into which an atomized mixture is to be sprayed, and a small radius trailing edge for facing oppositely to said leading edge;

a flowable medium conduit extending in said airfoil member and having an inlet and an outlet, for supplying flowable medium;

an atomizing gas conduit extending in said airfoil member and having an inlet and an outlet, for supplying atomizing gas;

at least one mixing chamber in said airfoil member connected to the outlets of said flowable medium conduit and said atomizing gas conduit for mixing the medium with the atomizing gas to form an atomized mixture;

nozzle means connected to said chamber and extending from said trailing edge for spraying the atomized mixture in a downstream direction into the gas stream;

a nacelle connected to said trailing edge and extending over said nozzle means, said nacelle defining a shielding gas discharge space for discharging shielding gas from said airfoil member around said nozzle means and in the downstream direction into the gas stream and shielding gas supply means connected to said airfoil member for supplying shielding gas to the discharge space.

2. An apparatus according to claim 1 wherein said flowable medium conduit comprises an inner header manifold and said atomizing gas conduit comprises an outer header manifold surrounding said inner header manifold and defining an annulus for the passage of atomizing gas, part of an exterior surface of said outer header manifold forming said leading edge of said airfoil member.

3. An apparatus according to claim 2 wherein said airfoil member includes an airfoil skin connected to said outer header manifold and forming a smooth aerodynamic surface terminating at said trailing edge, said nacelle being connected in a smooth transition to said airfoil skin.

4. An apparatus according to claim 3 wherein said nozzle means comprises an inner barrel connected to said inner header manifold, an outer barrel connected to said outer header manifold and defining an annular space around said inner barrel, said mixing chamber communicating with said annular space and with said inner barrel, and a nozzle cap with at least one orifice connected to said chamber for discharging the atomized mixture through said orifice.

5. An apparatus according to claim 4 wherein said nacelle extends around and defines an annulus with said outer barrel to form said discharge space.

6. An apparatus according to claim 5 wherein said nacelle includes an internal flow distributing orifice for uniformly distributing shielding gas.

7. An apparatus according to claim 1 wherein said airfoil member comprises a airfoil skin defining an interior space having opposite ends, a mounting plate having an opening therein closing one end of said skin and a register plate closing the opposite end of said skin, said skin having an opening in said trailing edge of said airfoil member covered by said nacelle, with the interior space of said skin defining said shielding gas supply means.

8. An apparatus according to claim 7 wherein the nacelle extends by at least an amount equal to a diameter of the nacelle, beyond said trailing edge of said airfoil member with aspect ratio of said nacelle internal diameter to atomizer outside diameter being not less than 1.5 nor greater than 6.0.

9. An apparatus according to claim 8 including a plurality of nozzle means spaced along and extending from said trailing edge of said airfoil member, with a nacelle connected to said trailing edge extending over each of said nozzle means.

10. An apparatus according to claim 1 wherein said flowable medium conduit and atomizing gas conduit comprises concentric inner and outer header manifolds, said inlet of said atomizing gas conduit comprising a service supply lateral connected to said outer header manifold.

11. An apparatus according to claim 10 including a mounting plate connected to an end of said airfoil member adjacent said service supply lateral, said mounting plate having an opening therein communicating with the interior of said airfoil member, said opening in said mounting plate and the interior of said airfoil member forming said shielding gas supply means, said airfoil member having an opening in said trailing edge thereof covered by said nacelle for receiving shielding gas from the interior of said airfoil member to the discharge space defined by said nacelle.

* * * * *